US009364049B2

(12) United States Patent
Jones

(10) Patent No.: US 9,364,049 B2
(45) Date of Patent: Jun. 14, 2016

(54) COVER BUTTON TEMPLATE TOOL AND METHOD FOR USING SAME

(71) Applicant: Stephanie Ann Jones, Brick, NJ (US)

(72) Inventor: Stephanie Ann Jones, Brick, NJ (US)

(73) Assignee: Stephanie Jones, Brick, NJ (US)

( * ) Notice: Subject to any disclaimer, the term of this patent is extended or adjusted under 35 U.S.C. 154(b) by 422 days.

(21) Appl. No.: 13/998,092

(22) Filed: Oct. 1, 2013

(65) Prior Publication Data

US 2015/0089772 A1 Apr. 2, 2015

(51) Int. Cl.
*A44B 1/06* (2006.01)
*A44B 1/12* (2006.01)

(52) U.S. Cl.
CPC . *A44B 1/06* (2013.01); *A44B 1/126* (2013.01); *Y10T 24/367* (2015.01)

(58) Field of Classification Search
CPC ..... A44B 1/06; A44B 1/126; Y10T 24/367
USPC ..... 79/1–18
See application file for complete search history.

(56) References Cited

U.S. PATENT DOCUMENTS

2004/0148794 A1* 8/2004 McLean ..... B26B 5/00 33/562

FOREIGN PATENT DOCUMENTS

FR 2720907 A1 * 12/1995 ..... A41H 3/01

OTHER PUBLICATIONS

Helix Small Circle Template, Amazon.com: Transparent templates, Dec. 2012.*

* cited by examiner

*Primary Examiner* — Mark Rosenbaum

(57) ABSTRACT

A transparent template for use with cover button kits which allows the user to view the underlying pattern or image on the cloth prior to cutting in order to determine the exact pattern and/or image which will appear on the face of the button upon fabrication, the transparent template comprising an upper and lower planar surface defined by an outer circular periphery and in inner circular periphery defining a circular window through the transparent template, the transparent template slidably positioned on the piece of cloth to be cut, and slidably moved until the desired pattern or image appears in the circular window allowing the user to then cut the cloth about the circular window for use with a cover button kit, the transparent templates coming in various sizes with various sized circular windows to accommodate buttons of varying sizes.

3 Claims, 2 Drawing Sheets

COVER BUTTON TEMPLATE TOOL AND METHOD FOR USING SAME

RELATED APPLICATIONS

This application is a divisional application of application Ser. No. 12/658,718, filed Feb. 16, 2010.

BACKGROUND OF THE INVENTION

1. Field of the Invention

The present invention relates to the field of fashioning cover buttons, that is decorative buttons covered with cloth, and in particular, to a template for cutting the cloth which allows the user to identify and choose the exact portion of the cloth pattern which will be positioned on the face of the button.

2. Description of the Prior Art

The art of covering buttons with a cloth pattern has been a practice for many generations. A button covered with the cloth pattern of the attached dress or other garment camouflages the button when it is actually worn. This is practical for formal dresses, wedding gowns, and other formal wear. Additionally, with childrens garments and clothes, it is fanciful to have the buttons covered with a cloth pattern or image which is complimentary with the underlying pattern or images on the garment worn by the child. This is applicable to all garments, but in particular to costumes and the like.

Still further, with respect to furniture, and window treatments where buttons are present, it is oftentimes advisable from an aesthetic standpoint to cover the buttons with cloth of the furniture or window treatment material in order to camouflage or have the buttons blend into the particular piece of furniture or window treatment.

Kits exist in various button sizes which include all of the elements of the button, including a mold for fashioning such cover buttons. The drawback with such kits is that they come with a cardboard template cutout for the particular button size associated with the kit. The cardboard cutout template is opaque and merely provides the user with the circumference of cloth required in order to cover the particular size button associated with the kit. This works well if the cloth is unpatterned, but presents a problem if the cloth is patterned or the cloth is patterned with particular images which the user desires to center on the button after it is cloth covered so as to be the predominant feature of the covered button. The opaque template thwarts the user's desires.

Applicant has come up with a transparent series of templates to different size buttons which allows the user to not only cut the cloth to the desired size for the particular size button, but also allows the user to center and particularly select the pattern or image on the cloth which the user desires to have centered on the button when the cloth is applied to the button.

OBJECTS OF THE INVENTION

An object of the present invention is to provide for a novel transparent template utilized with a cover button kit which allows the user to position the template over a particular pattern and/or image on a piece of cloth, and to cut the cloth for use as a cover button cloth which insures that the desired pattern or image will be centered on the button after fabrication.

Another object of the present invention is to provide for a novel transparent template for use with cover button kits, the template coming in various sizes, which accommodate buttons of various sizes.

A still further object of the present invention is to provide for a novel transparent template for use with cover button kits which allows the user to facilely size the transparent template over the cloth to be cut to allow the user to visualize the optimum pattern or image which the user would wish to have centered on the button upon fabrication.

SUMMARY OF THE INVENTION

A transparent template for use with cover button kits which allows the user to view the underlying pattern or image on the cloth prior to cutting in order to determine the exact pattern and/or image which will appear on the face of the button upon fabrication, the transparent template comprising an upper and lower planar surface defined by an outer circular periphery and in inner circular periphery defining a circular window through the transparent template, the transparent template slidably positioned on the piece of cloth to be cut, and slidably moved until the desired pattern or image appears in the circular window allowing the user to then cut the cloth about the circular window for use with a cover button kit, the transparent templates coming in various sizes with various sized circular windows to accommodate buttons of varying sizes.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
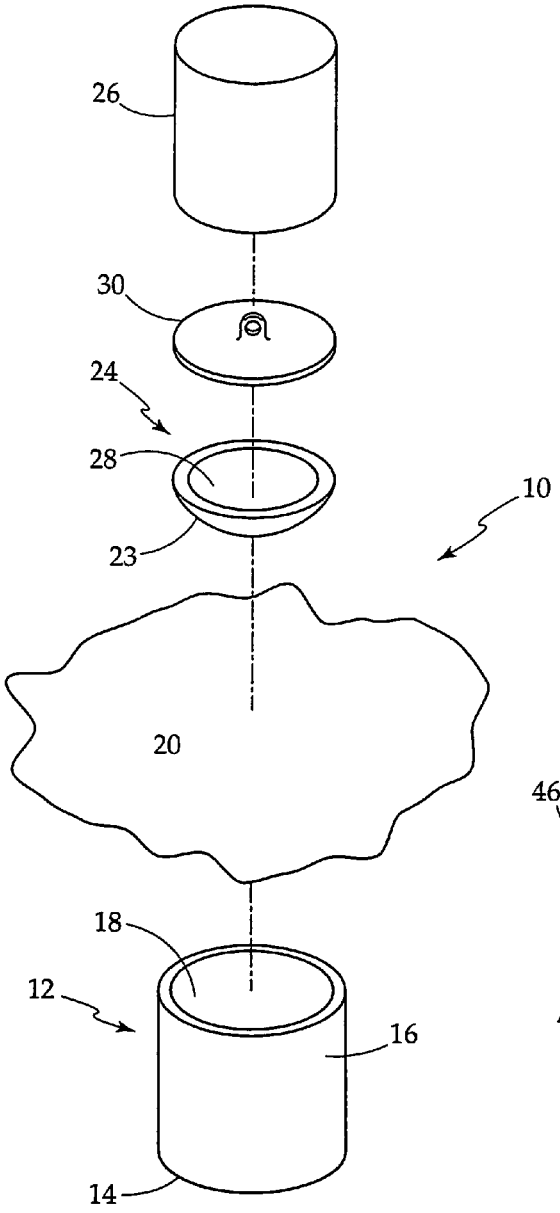
FIG. 1 is an exploded view of a typical cover button kit.
Figure 2:
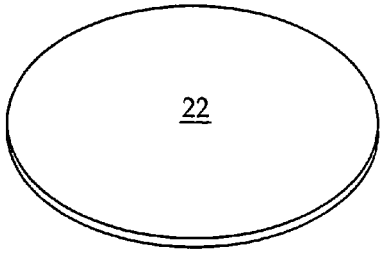
FIG. 2 Prior Art
FIG. 2 is a perspective view of a typical opaque template provided with the cover button kit of FIG. 1.

FIG. 1 is an exploded view of the elements of a cover button kit 10 of the prior art. Such kits are typically sold in blister packs wherein a cardboard backing portion provides the information and directions and the protruding plastic pocket or blister includes the necessary elements to fashion cover buttons. The cardboard backing of the blister pack would normally identify the size of the buttons contained therein, and the cardboard backing of the blister pack would normally have an embossed circulate opaque template for use with the particular sized buttons associated with the blister pack for the user to use to cut the cloth to the correct size.

The elements of FIG. 1 are shown in exploded view to illustrate the manner in which the cover button is fabricated. The kit or package includes a mold 12 having a bottom 14 and a cylindrical side wall 16, defining a cavity 18, cavity 18 being sized to the particular sized button associated with the particular blister pack or packaging.

A piece of fabric or cloth 20 would be cut in a circular shape utilizing the opaque circular template 22 which was embossed onto the cardboard backing of the blister pack, and was removed by cutting or punching it out. The fabric or cloth 20 so cut is positioned over cavity 18 of mold 12. A button shell 24, a plurality of which come with each kit, is then pressed firmly into the mold using a cylindrical press or push 26 which comes with the kit. Button shell 24 is formed with a front face portion 23 and a rear cavity portion 28. It should be noted that the fabric or cloth 20 should be positioned over the mold 12 with the wrong side up, that is the image or pattern side which the user desires to have visible on the button when the fabrication is completed, should be facing downwardly.

Once the button shell 24 has been pressed into the mold 12, the excess peripheral cloth or fabric 20 is tucked into the rear cavity portion 28 in the back of the button shell 24. At this point, a button back 30 is positioned over the tucked fabric in the rear cavity 28 of button shell 24 and the cylindrical press or push 26 is pressed down firmly to snap the button back 30 into locking relationship with the button shell 24, thus securing and capturing excess fabric or cloth in the rear cavity portion 28 of button shell 24 and insuring the desired pattern or image is captured and secured on the face of button shell 24.

This procedure works well if the fabric contains no pattern or images, however, if there is a particular pattern or image on the cloth or fabric which the user wishes to center upon the button shell 24 upon completion of fabrication, the circular opaque template 22 provided with the kit does not permit the user to accomplish this task, the opaque circular template 22 only identifies the circumference to be cut from the cloth or fabric 20 in order to fabricate a cover button associated with the size of the buttons contained in the blister pack with which it is provided.

Figure 3:
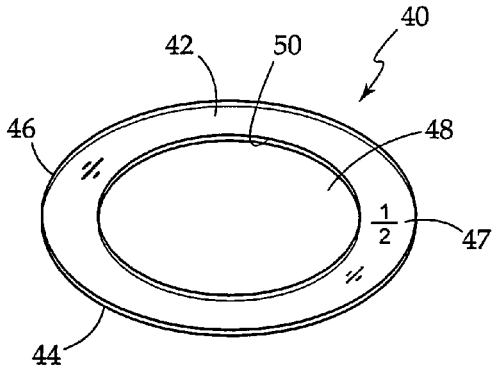
FIG. 3 is a perspective view of a transparent cover button template of the present invention.
Figure 4:
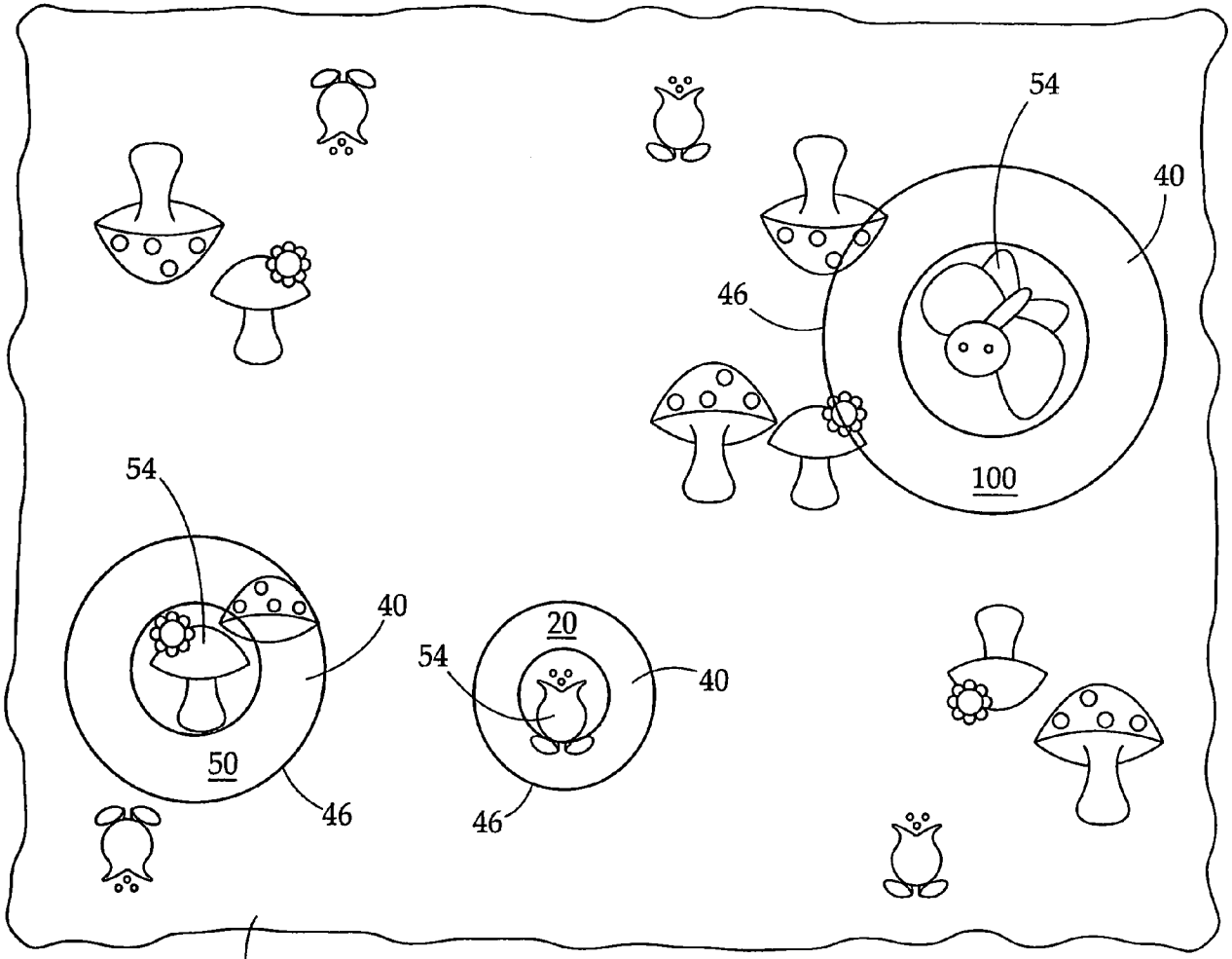
FIG. 4 is a planar view of a plurality of different sized transparent cover button templates of FIG. 3 positioned on a patterned piece of cloth.

FIGS. 3 and 4 illustrate the transparent cover button template 40 of Applicant's invention and the benefits of its use, particularly when utilizing cloth or fabric 20 having patterns or images. The transparent cover button template 40 is doughnut or toroidal in shape having a planar upper surface 42 and a planar lower surface 44 defined by an outer circumferential periphery 46. Transparent cover button template 40 has a central aperture 48 defined by an inner circumferential wall 50. Transparent cover button template 40 can be formed from any suitable transparent material, but preferably is formed from a transparent non-breakable, shatter-proof polymer.

The central aperture 48 is sized in diameter to the size and diameter of a button shell. Therefore the transparent cover button template 40 can come in various sizes with various size central apertures 48 in order to match the diameter of a plurality of different sized button shells. For ease of use, the size of the central aperture 48 in the transparent cover button template 40 can be embossed or etched 47 into the upper or lower surfaces 42 or 44 for ease of identification by the user.

FIG. 4 illustrates the ease of use of the transparent cover button template 40 by the user. In FIG. 4, a piece of cloth 52 presents a fanciful childrens pattern 54. If the user wished to fabricate a cover button with one of the designs 54 being present on the front of the button shell, the user would determine the size of the button shell being utilized, and then select the appropriate sized transparent cover button template 40. FIG. 4 illustrates three templates of three different sizes. The user would slide the transparent cover button template 40 over the cloth or fabric until one of the patterns or designs 54 was positioned within the central aperture 50 of the selected transparent cover button template 40. The user would then cut the material about the outer circumferential periphery 46 of the transparent cover button template 40. The distance between the inner circumferential periphery 50 and the outer circumferential periphery 46 defines the precise amount of fabric which will be in excess of that needed to cover the front face 23 of the button shell 24, and defines the precise amount of fabric which can be tucked or folded into the rear cavity 28 of the button shell to be secured by the button back 30. Once the fabric containing the design or image 54 has been cut, the user would follow the steps as outlined with respect to FIG. 1 with the assured knowledge that when the steps associated with FIG. 1 are completed, the user will be presented with a cover button in which the desired design appears on the front face.

Therefore, while the present invention has been disclosed with respect to the preferred embodiments thereof, it will be recognized by those of ordinary skill in the art that various changes and modifications can be made without departing from the spirit and scope of the invention. It is therefore manifestly intended that the invention be limited only by the claims and the equivalence thereof.

I claim:

1. An improved method of forming a cover button and insuring that the desired image, pattern, or indicia of the fabric or cloth will appear on the face of the cover button, the steps comprising:

utilizing a transparent cover button template having a planar upper surface and a planar lower surface, and a circular outer periphery, said transparent cover button template having a central circular aperture defined by an inner side wall sized to a dimension of a button shell;

sliding said transparent cover button template over said fabric or cloth until said desired indicia, image, or design is positioned within said central aperture, the radial distance from said inner side wall of said central circular aperture to said circular outer periphery defining an amount of excess circumferential material to be folded into said rear cavity of a button shell;

cutting said fabric or cloth about said circular outer periphery of said transparent cover button template;

positioning said cut fabric, indicia, image, or pattern face down over a cover kit mold;

positioning said button shell over said cloth in said mold and pressing downwardly;

folding said excess circumferential material of said cut fabric or cloth into said rear cavity of said button shell;

positioning a button back over said rear cavity of said button shell; and pressing said button back into snap fit relationship with said button shell forming said cover button.

2. The improved method of forming a cover button in accordance with claim 1 wherein said central aperture of said transparent cover button template when positioned on said cloth or fabric identifies the precise portion of said cloth of fabric to be positioned on a face of said button shell.

3. The improved method of forming a cover button in accordance with claim 1 wherein said size of said central circular aperture of said transparent cover button template is identified by indicia on said upper or lower surface of said transparent cover button template so as to match the correct sized transparent cover button template to the button shell.

* * * * *